United States Patent [19]

Brown

[11] Patent Number: 4,520,580

[45] Date of Patent: Jun. 4, 1985

[54] SKATE BOOT INSERT

[76] Inventor: Dennis N. Brown, 1091 Fir Ave., Blaine, Wash. 98230

[21] Appl. No.: 363,548

[22] Filed: Mar. 30, 1982

[51] Int. Cl.[3] ..... A43B 13/38

[52] U.S. Cl. ..... 36/44; 36/58.6; 36/115

[58] Field of Search ..... 36/43, 44, 115, 58.6, 36/91, 92, 93, 114

[56] References Cited

U.S. PATENT DOCUMENTS

| | | | |
|---|---|---|---|
| 171,987 | 1/1876 | Burke | 36/43 |
| 581,146 | 4/1897 | Young | 36/44 X |
| 1,741,419 | 12/1926 | Jones | 36/43 X |
| 1,872,987 | 8/1932 | Langer | 36/43 |
| 3,601,908 | 8/1971 | Gilkerson | 36/43 |
| 3,638,336 | 2/1972 | Silverman | 36/44 |
| 4,167,824 | 9/1979 | Wolpa | 36/44 |
| 4,305,212 | 12/1981 | Coomer | 36/44 X |
| 4,338,734 | 7/1982 | Schwartz | 36/44 |
| 4,435,910 | 3/1984 | Marc | 36/44 |

FOREIGN PATENT DOCUMENTS

| | | | |
|---|---|---|---|
| 1389655 | 1/1965 | France | 36/43 |
| 1509112 | 12/1967 | France | 36/44 |

*Primary Examiner*—Werner H. Schroeder
*Assistant Examiner*—T. G. Graveline
*Attorney, Agent, or Firm*—Leonard Bloom

[57] ABSTRACT

An insert for use in ice skates and the like which includes a blank pad having a top layer with an upper surface provided with a contour substantially complemental to the plantar surface of a person's foot, the top layer formed from suitable material to resist abrasion and absorb perspiration. The top layer is bonded to an intermediate layer formed of resilient material, a bottom of the intermediate surface affixed to a lower surface having a bottom layer provided with an alignment device for registry with the center line of a skate whereby deformation of the blank occurs along its longitudinal axis directly above the skate blade, the deformation of the blank causing a cradling and supporting effect upon the foot disposed within the skate so as to provide not only better centering over the skate blade, but also an improved load transmission from the foot through the leg resulting in overall better balance and skate edge control.

16 Claims, 3 Drawing Figures

FIG 1
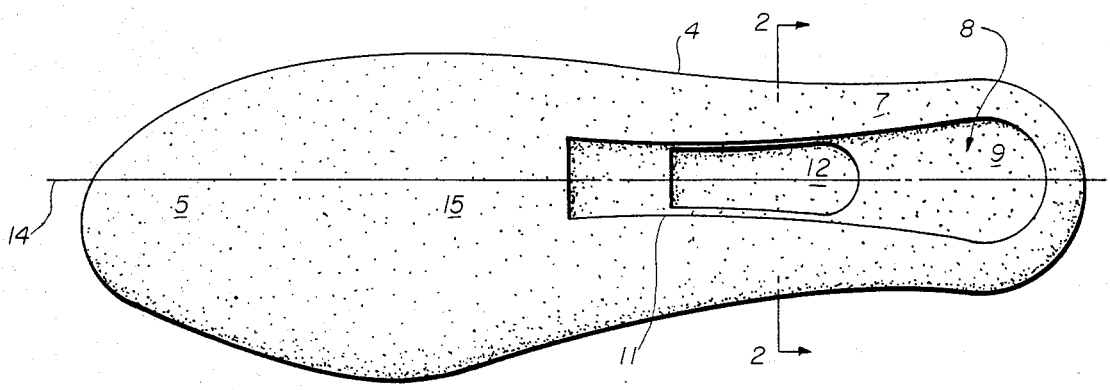
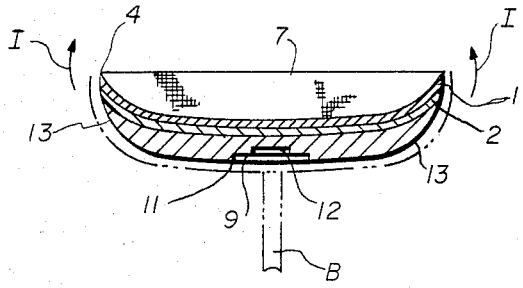
FIG 2
FIG 3
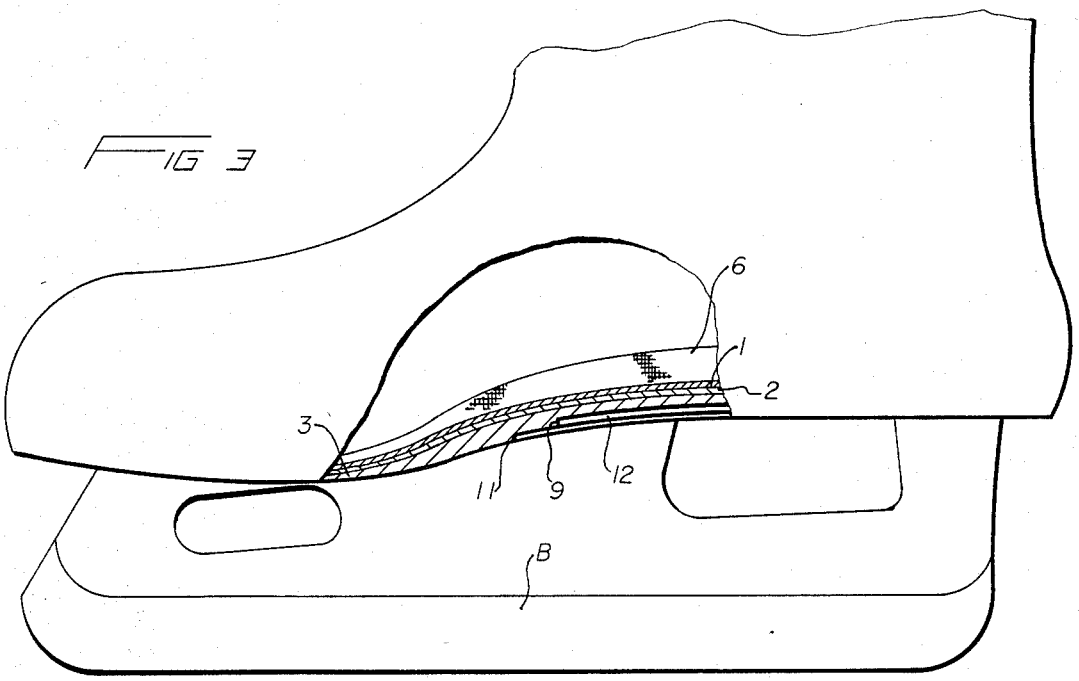

SKATE BOOT INSERT

BACKGROUND OF THE INVENTION

This invention relates generally to sock liner inserts for ice skates or the like.

This invention represents a further development in and is related to the art disclosed in U.S. patent application Ser. No. 316,721, filed Oct. 30, 1981, now U.S. Pat. No. 4,413,430.

For an ice skater, the secure alignment of the foot directly over and along the blade of the skate is integral to performance. When viewed from front or aft, optimum alignment is to have the plane of the blade directly coincide with the sagittal plane of the foot and further directly align with the long axis of the superimposed lower leg. In skating any time the ankle joint and subtalar joint complex is abnormally inverted or everted the alignment must be corrected by direct muscle effort or change in the body position so that the forces related to the thrust of the blade can be readily transmitted from the leg and upper torso as well as forces from the upper torso and leg to the foot to create forward motion. Constant correction and/or the failure to correct the alignment of the ankle and subtalar joint complex relative to the leg reduces the skating efficiency and increases both medial and lateral stress to the ankle. Medial and lateral stress on the ankle and the subtalar joint complex and the required correction associated therewith overwork the muscles employed to correct the alignment which results in reduced efficiency, fatigue, and possible injury. Therefore, the goal is to eliminate lateral stress by maintaining the correct alignment of the subtalar joint in a neutral position relative to the tibia and fibula.

The boot of a skate attempts to capture the ankle in the beneficial alignment described above. In the past, in order for the skate boot to firmly grasp the foot and ankle associated therewith, the boot laces were drawn as tight as possible. This may result in grasping the ankle, but is also causes poor blood circulation in the foot, muscle cramping, fatigue, and general discomfort. In essence, overtighting of the laces is an attempt to make the plantar surface of the foot conform to the topography of the bottom of the skate boot. This overstresses the skeletal structure of the foot and deforms the plantar contour of the foot in an attempt to fit the foot to the boot. Instead, the contours of the skate boot, especially along the interior sole, should be made to conform to an individual's foot and not vice versa. Furthermore, the process of weighting and unweighting changes the contour of the foot as the muscles flex and the stresses are distributed. Prior art devices have attempted to address these problems by providing a sock liner insert constructed of foam to conform to an individual's foot and furnish mild shock absorption qualities.

The following patents represent the state of the art of which applicant is aware insofar so these references appear to be germane to the patent process: U.S. Pat. No. 2,660,814, Ritchey, U.S. Pat. No. 2,680,919, Riggs, U.S. Pat. No. 3,118,153, Hood, U.S. Pat. No. 3,638,336, Silverman, U.S. Pat. No. 3,922,801, Zente, U.S. Pat. No. 3,981,602, Ogden, U.S. Pat. No. 4,017,656, Lasman et al., U.S. Pat. No. 4,055,699, Hsiung, U.S. Pat. No. 4,187,621, Cohen, French Pat. No. 1,240,066, U.K. Pat. No. 465,940.

The above-mentioned references can be characterized as orthopedic appliances for general use, therefore their configuration is likewise general in nature.

By way of contrast, the instant invention is an insert specifically designed for an ice skate and the unique requirements associated therewith. As discussed above, foot alignment relative to the blade and ankle alignment relative to the leg is crucial in determining the relative efficiency and power that can be generated by an ice skater. The foot must directly overlie and remain balanced in relation with the blade, and furthermore the ankle and the subtalar joint complex must remain in a neutral position in relation to the leg. The instant application is distinguished from prior art devices in that a two-stage recess appearing on a bottom surface of the insert causes a controlled deformation of the insert so that in a weighted position the edges of the insert curl up and cup the calcaneal area of the foot and in an unweighted position the memory of the material returns the insert to its original configuration. The controlled deformation of the insert due to the recess aids in the beneficial alignment of the foot relative to the blade and the ankle relative to the leg.

SUMMARY AND OBJECTS OF THE INVENTION

Accordingly, it is a primary object of the present invention to provide a novel skate boot insert which promotes a beneficial alignment of the foot relative to the blade, as well as the ankle and the subtarsal joint complex relative to the leg to increase skating efficiency and power and to decrease fatigue and incidence of injury.

It is another object of the present invention to provide a novel insert for a skate boot which adjusts to the varying contours of the foot in both the weighted and unweighted position so that free space inside the skate boot is eliminated without requiring overtightening of the boot laces.

It is a further object of the present invention to provide a novel skate boot insert which contours to the general configuration of an individual's foot by a process of controlled self deformation.

Still another object of the present invention is to provide a novel skate boot insert which is easy to manufacture and lends itself well to mass production techniques.

These and other objects will be made manifest when considering the following detailed specification when taken in conjunction with the accompanying drawing figures.

BRIEF DESCRIPTION OF THE DRAWING FIGURES

FIG. 1 is a bottom view of the insert.

FIG. 2 is a cross-sectional view taken along lines 2—2 of FIG. 1.

FIG. 3 is a side cutaway view of a skate boot with the insert in place.

DESCRIPTION OF THE PREFERRED EMBODIMENT

Referring now to the drawings in detail wherein like reference numerals refer to like parts, reference numeral 10 refers generally to the insert.

The ice skate insert 10 is essentially a three layered foot pad. The top layer 1 is formed from a cloth material or the like such as nylon, dacron, felt or a synthetic fabric, which is durable as well as sufficiently porous to absorb perspiration. The second layer 2 is a coextensive underlying resilient pad which is perferably formed from neoprene, rubber, sponge or the like. The third layer 3 is likewise coextensive and forms the bottom surface of the insert. This layer 3 is perferably formed from a foam material such as Freelen Tm, Plastizote Tm, or any of a number of open or closed celled foams characterized as being relatively resilient, having sufficient memory to return to its original state when unstressed, and capable of moderate shock absorption. The three layers 1, 2, and 3 are permanently affixed to one another by any suitable technique such as adhesion or fusion.

All three layers 1, 2 and 3 are used to form a peripheral lip 4 which is upwardly curved and defines the edge of the insert 10. The insert 10 is contoured in a configuration which generally resembles the contours of the bottom of a typical foot. Thus, the insert has a widened toe area 5 (FIG. 1), a raised arch area 6 (FIG. 3), and a calcaneal or heel cup 7 (FIG. 2). The foamed materials from which the insert 10 is constructed deform to fit the unique contours of the bottom of an individual's foot in the weighted position. In the unweighted position the insert 10 has a memory which returns it substantially to its original shape.

The toe area 5 or the area forward of the metatarsal area 15 is substantially of uniform thickness through the three layers 1, 2 and 3. With continued use this area 5 permanently deforms to a minor extent creating a ridge in the toe area 5 beneath the toes upon which the toes may grip. The upwardly curving lip 4 helps nest in position the forward portion of the foot.

A two stage recess, generally referred to by reference numeral 8 appears on the bottom of the third layer 3 running longitudinally from the metatarsal head area 15 to the calcaneal region 7. The recess 8 is symmetrically disposed about a longitudinal line 14. The blade B lies directly underneath the longitudinal line 14 and therefore the recess 8. The first stage 9 of the recess 8 is substantially a keyway shaped indentation defined by a sharp edge 11 developing into a curved trailing edge configuration in the calcaneal region 7 and a square forward portion configuration in the metatarsal head area 15. Similarly, the second stage 12 of the recess 8 is a further indentation symmetrically disposed within the first stage 9. The second stage 12 is substantially a smaller version of the first stage 9 and has a similar configuration. The recess 8 is used to influence the performance of the upwardly extending lip 4 as described hereinafter.

The recess 8 creates a heel gripping effect. When weight is applied to the upper layer 1, which directly overlies the recess 8, the insert 10 begins to deform under the load. Light loads cause slight deformation, greater loads result in greater deformation. The lateral portions of the third layer 3 directly surrounding the recess 8 are provided with an arcuate marginal portion 13 (FIG. 2) which rises to form the upwardly extending lip 4. Thus, when a load is applied to the insert 10, the recess 8 causes a controlled deformation forcing the lip 4 to migrate in the direction of the arrows I in FIG. 2. This results in a heel gripping effect in the calcaneal area 7 due to the beneficial migration of the upwardly extending lip 4 which surrounds the skater's heel. The greater the load, the greater the migration of the lip 4. In the unweighted position, the memory of the insert 10 and the recess 8 return the insert 10 to its original configuration.

The second stage 12 of the recess 8 disposed within the first stage 9 creates a preferred zone of primary deformation when weight is applied to the insert 10. The first stage 9 responds to the weight after the second stage 12 creating an extended zone of controlled deformation. Thus, as soon as weight is applied to the insert 10, deformation begins first in the area of the lip 4 which is longitudinally coextensive with the second stage 12. This locates the foot directly over the blade B. As more weight is applied to the insert 10 more of the lip 4 migrates creating the heel cupping effect previously described. Operating in combination, the first stage 9 and the second stage 12 of the recess 8 cause a deformation of the insert 10 which first locates the foot in a beneficial position and then securely grasps the heel helping to prevent any lateral destabilization of the sub-talar joint in the ankle. This results in a more efficient and powerful skating technique.

Furthermore, when the skate blade B is angulated in relation with the ice, which is normal during the thrust of a skate blade, the load applied to the insert varies. The load is greater on the medial side of the insert which causes increased insert deformation on that same side thereby offering greater support where needed most.

It should also be noted that different types of skating, such as figure skating, require different edging techniques, therefore it is contemplated in this invention to vary the size and position of the recess 8 to suit the requirements of different styles of skating.

Having thus described the preferred embodiment of the invention, it should be understood that numerous structural modifications and adaptations may be resorted to without departing from the spirit of the invention.

What is claimed is:

1. An insert placed within an ice skate boot or the like comprising in combination;

a blank having a top layer with an upper surface generally contoured to conform to a plantar surface of a person's foot, a lower layer having a bottom face provided with a recess means extending substantially from the metatarsal area to the calcaneal area of the foot, said recess means centrally disposed over a blade of an ice skate, said recess means including first and second recess areas wherein said second recess area is disposed concentrically within said first recess area.

2. The device of claim 1 wherein said recess means includes a curved trailing edge proximate to the calcaneal area, and a rectangulr forward portion proximate to the metatarsal area.

3. The device of claim 1 wherein said recess means is provided at a lateral extremity thereof with a sharply defined side edge intermediate said trailing edge and said forward portion.

4. The device of claim 3 in which said sharply defined side edge is provided on both laterally extreme sides of said recess means.

5. The device of claim 4 in which marginal portions are provided having a curved contour extending upwardly to said upper surface from said edges.

6. The device of claim 5 in which a peripheral lip extends around the heel calcaneal area of the foot, formed from the conjunction of said marginal portions with a periphery of said top layer whereby deformation of said recess means provides corresponding cupping motion of said lip to more tightly grasp the heel of the foot.

7. The device of claim 6 wherein an intermediate layer is provided between said top and lower layers said intermediate layer formed of a resilient material.

8. The device of claim 7 in which said lower layer is formed from a foam adapted to return to an original configuration when unstressed.

9. The device of claim 8 in which said top layer is formed from an abrasion resistant and perspiration absorbent material.

10. An orthotic appliance comprising in combination:

a multi-layered insert including at least a top layer and a bottom layer and configured to generally conform to a plantar surface of a person's foot, the insert further including an upwardly-curved peripheral lip circumscribing a heel area of the foot, and the bottom layer having a substantially longitudinal keyway-shaped downwardly opening indentation formed therein substantially from the metatarsal head area into the calcaneal region, whereby the insert will deform due to the person's weight substantially over the indentation, thereby causing the peripheral lip to cup inwardly for improved gripping of the person's heel.

11. The appliance of claim 10 wherein said indentation comprises a first recess, and wherein a second recess is concentric to and disposed within and therefor dimensioned smaller than said first recess to provide said second recess with the ability to respond initially to loads and said first recess thereafter.

12. The appliance of claim 11 wherein both said first and second recesses are substantially keyway shaped with an arcuate trailing edge underlying the heel, a leading edge transverse to the foot's longitudinal axis and side edges extending from said leading edge to said trailing edge.

13. The appliance of claim 12 wherein areas outboard said first recess adjacent said side edges and trailing edge curve upwardly in an arc, terminating in said peripheral lip.

14. The appliance of claim 13 wherein areas outboard said first recess adjacent said side edges and trailing edge curve upwardly in an arc, terminating in a peripheral lip.

15. A device for controlling articulation of a foot relative to the foot's associated leg at its ankle comprising in combination:

a blank having a top surface configured to generally conform to a plantar surface of the foot, a zone of deformation within said blank responsive to a load imposed on said blank wherein degrees of blank deformation correlate to magnitude of load imposed, whereby deformation at said zone flexes said blank at its lateral edges to grasp the foot more firmly and urge the foot relative to its leg to orient its ankle into a neutral axis position, wherein said zone of deformation includes a recess means having a first recess in said blank underlying a central calcaneal area of the foot and terminating at a metatarsal head area whereby deformation of said blank at said recess means promulgates enhanced heel cupping, wherein said recess means includes a second recess concentric to, disposed within and therefor dimensioned smaller than said first recess to provide said second recess with the ability to respond initially to loads and said first recess thereafter.

16. The device of claim 15 wherein said first and second recesses are substantially keyway shaped with an arcuate trailing edge underlying the heel, a leading edge transverse to the foot's longitudinal axis and side edges extending from said leading to said trailing edge.

* * * * *